United States Patent [19]

Hyytinen

[11] 3,968,727

[45] July 13, 1976

[54] FIREARM WITH GAS-OPERABLE STRUCTURE AND RELIEF VALVE

[75] Inventor: Timo Hyytinen, Jyvaskyla, Finland

[73] Assignee: Valmet Oy, Finland

[22] Filed: Apr. 26, 1974

[21] Appl. No.: 464,639

[30] Foreign Application Priority Data

Apr. 27, 1973 Finland ..... 1356/73

[52] U.S. Cl. ..... 89/191 A; 89/193

[51] Int. Cl.[2] ..... F41D 5/08; F41D 5/10

[58] Field of Search ..... 89/191 A

[56] References Cited

UNITED STATES PATENTS

| | | | |
|---|---|---|---|
| 1,138,377 | 5/1915 | Hammond | 89/191 A |
| 2,909,101 | 10/1959 | Hillberg | 89/191 A |
| 3,261,264 | 7/1966 | Wilson | 89/191 A |
| 3,420,140 | 1/1969 | Beretta | 89/191 A |
| 3,779,131 | 12/1973 | Kawamura | 89/191 A |

*Primary Examiner*—Stephen C. Bentley

*Attorney, Agent, or Firm*—Steinberg & Blake

[57] ABSTRACT

A firearm having structure operated by gas pressure, upon firing of a round, as well as a relief valve for responding to excess pressure. A gas cylinder is fixed to a barrel of the firearm, forwardly of a magazine which extends beneath the barrel, this gas cylinder communicating with the barrel to receive gas under pressure therefrom upon firing of a round. A piston in the gas cylinder is moved rearwardly along the magazine when gas under pressure is received in the cyliner, so as to operate structure automatically in this way, and a guide for the piston extends forwardly from the magazine into the cylinder and is surrounded by the piston so as to guide the latter, the guide having a diameter smaller that the magazine and having a hollow interior which accommodates part of a magazine spring which urges rounds therein rearwardly. A relief valve forms a forward extension of the guide and communicates with the interior of the gas cylinder, forwardly of the piston, as well as with the outer atmosphere for relieving excess gas pressure in the cylinder to the outer atmosphere.

9 Claims, 2 Drawing Figures

FIREARM WITH GAS-OPERABLE STRUCTURE AND RELIEF VALVE

BACKGROUND OF THE INVENTION

The present invention relates to firearms.

In particular, the present invention relates to firearms such as semi-automatic shotguns, wherein upon firing of a round the gas pressure created is utilized for automatic operation of components of the firearm.

Thus, the present invention relates to firearms, in particular firearms such as semi-automatic shotguns, where a gas piston-and-cylinder assembly is provided with a pressure equalizing valve, the gas piston being mounted in a gas cylinder connected to the underside of the barrel of the firearm with the piston-and-cylinder assembly forming a continuation of a magazine tube which extends beneath the barrel, and the cylinder communicating at its front end region through a suitable gas passage with the interior of the barrel to receive gas under pressure therefrom when a round is fired.

It is known to provide for a semi-automatic shotgun an arrangement where the gas piston directly surrounds the magazine tube of the firearm. Through this expedient it is possible for the magazine to have a large capacity which, in the case of a semi-automatic shotgun, may be, for example, four cartridges. However, this type of construction has the disadvantage of requiring that the firearm have an objectionably great transverse dimension or thickness at the front butt region.

Also, there are known constructions where the gas piston and the cylinder in which it slides are arranged so as to form a continuation of the magazine tube with the gas piston reciprocating on the neck of a special solid rod which forms a continuation of the magazine tube. This type of construction requires an undesirably long space, considered longitudinally of the firearm.

In addition, it is extemely difficult in both of the above types of construction to accommodate a pressure relief valve which serves to equalize variations in pressure resulting from charges of different strengths. Thus, if an excessively strong charge is fired, the automatically operable structure of the gun will be driven with a force which is too strong, and a pressure relief valve is provided to avoid this undesirable operation.

SUMMARY OF THE INVENTION

It is accordingly a primary object of the present invention to provide a firearm construction which will avoid the above drawbacks.

In particular it is an object of the present invention to provide a firearm of the above general type with a gas piston-and-cylinder assembly as with a relief valve structure, in such a way that these components occupy less space than has heretofore been required, both longitudinally of the firearm and transversely thereof.

In addition it is an object of the present invention to provide a construction of the above type which is exceedingly simple so that it will operate reliably and have a low manufacturing cost.

Furthermore it is an object of the present invention to provide a construction of the above general type which is capable of operating in such a way that the force with which the piston is driven rearwardly by the gas under pressure can be regulated by braking the rearward movement of the piston in a controlled manner.

With the structure of the invention a gas cylinder means is fixed to the barrel beneath the latter and has an axis which is parallel to the barrel, this gas cylinder means communicating with the interior of the barrel to receive gas under pressure therefrom. Situated within the gas cylinder is a guide means which forms an extension of a magazine which extends rearwardly from the gas cylinder beneath the barrel, this guide means itself being hollow and forming an interior cylinder which is surrounded by and situated within the gas cylinder. The diameter of the guide means is smaller than the diameter of the magazine tube with the guide means being fixed to the magazine tube so as to form a forward extension thereof. In the annular space which is thus defined between the gas cylinder and the guide means there is a gas piston means of a substantially cylindrical construction sliding on the guide means and guided at its exterior by the interior surface of the gas cylinder means. A relief valve means is fixed to and forms a forward extension of the guide means, this relief valve means opening automatically in response to the presence of gas under pressure in such a way that excessive gas pressure may be discharged into the atmosphere so as to prevent excessively fast movement of the gas piston and the components operated thereby.

The gas piston has at its front end an inwardly directed flange which surrounds and slidably engages the guide means, and the space within the piston behind the latter flange serves as an air cushion to cushion the rearward movement of the piston, particularly at the end of its path of travel. The braking effect may be regulated by controlling the gap between a rear cylindrical portion of the piston and the magazine tube on which this rear cylindrical portion slides. In the same way, it is possible to increase the braking effect by increasing the free play or gap between the inwardly directed flange at the front end of the gas piston and the guide means surrounded by this flange so that the pressures at the front and at the rear of the piston flange may be equalized more rapidly.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
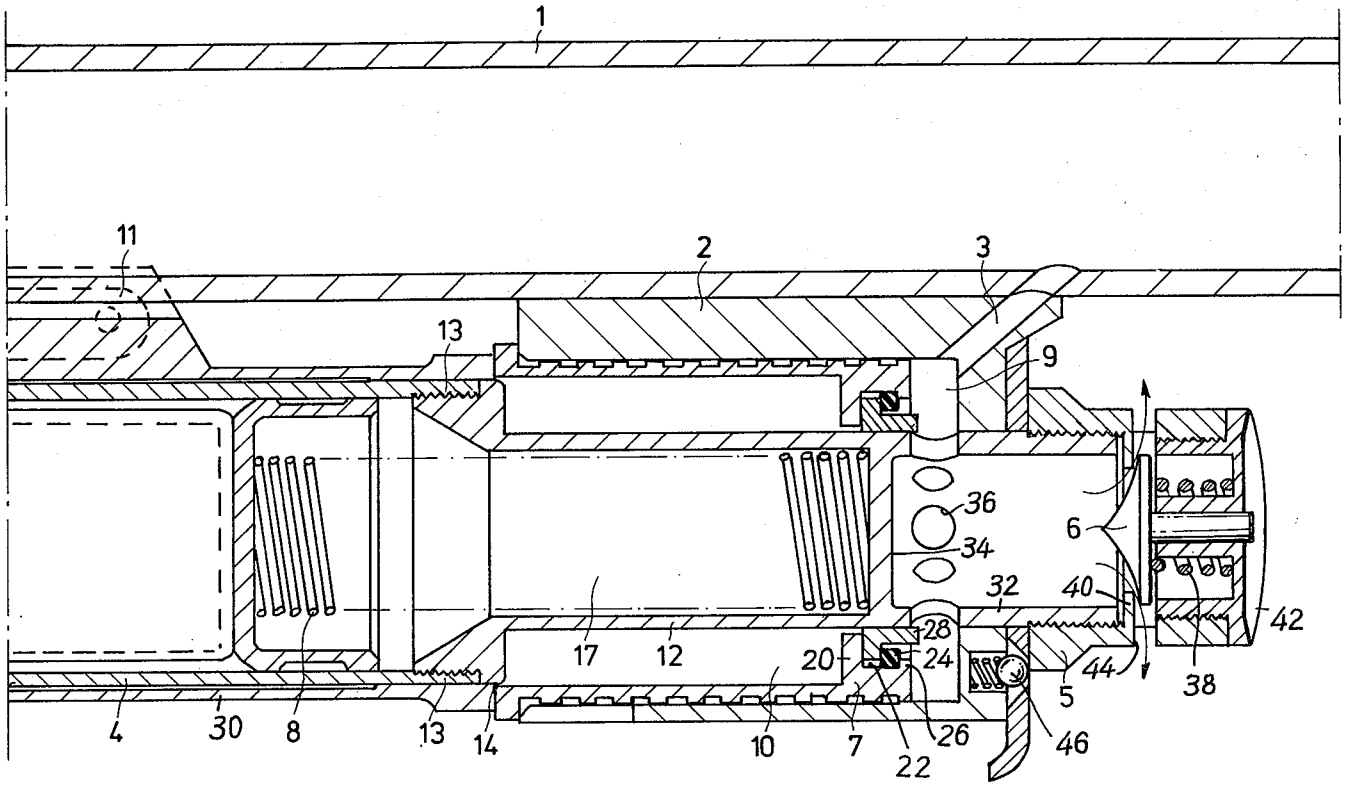
FIG. 1 is a fragmentary sectional elevation of one embodiment of a structure of the present invention, the section of FIG. 1 being taken in a plane which contains the axis of the barrel as well as the common axis of the gas cylinder and magazine tube.

Referring first to FIG. 1, there is fragmentarily illustrated therein the barrel 1 of a firearm such as a semi-automatic shotgun. A gas cylinder means 2 is fixed to lower surface of the barrel 1, as by being brazed thereto. A gas passage 3 is drilled through adjoining wall portions of the barrel 1 and the cylinder 2 at the front end region of the latter, so that through the passage 3 gas under pressure can enter into the hollow interior 9 of the gas cylinder means 2 upon firing of a round.

Situated beneath the barrel 1 is a magazine means in the form of an elongated magazine tube 4 capable of accommodating in its interior a number of rounds to be fired, such as, for example, four rounds, and part of one of the cartridges in the magazine tube 4 is shown at the lower left of FIG. 1. The cartridges or rounds in the magazine tube 4 are urged to the rear by way of a spring means 8 which is accommodated in the interior of the magazine tube 4, the left end of the spring 8, as viewed in FIG. 1, pressing against a cup member which slides along the interior of the magazine tube 4 engaging the last one of the rounds in the magazine, which is situated at the forwardmost part of the series of rounds stored in the magazine tube.

In the example of FIG. 1, the magazine tube 4 has an internally threaded portion 13 receiving external threads at the rear end of an elongated guide means 12 which is fixed by way of the threads 13 to the magazine tube 4 so as to form a coaxial extension of the latter, this guide means 12 extending along the interior of the gas cylinder means 2 and being coaxial therewith. It will be noted that the guide means 12 is hollow and has an interior hollow space 17 into which the spring means 8 extends, engaging a transverse wall of the guide means 12 at the front end thereof, as illustrated in FIG. 1. Furthermore it will be noted that the diameter of the guide means 12 is smaller than the diameter of the magazine tube 4 and that the guide means 12 has at its rear end an outwardly directed flange which is provided with the threads received by the internal threads 13 of the magazine tube 4, this flange having an inner taper forming the transition between the interior of the magazine tube 4 and the interior of the guide means 12.

The hollow interior 9 of the gas cylinder means forms part of the annular space which is defined between the guide means 12 and the gas cylinder means 2, the remainder of this annular space being formed by the space 10 within the hollow interior of a gas piston means 7. The gas piston means 7 has an exterior surface slidably engaging the interior surface of the gas cylinder means 2, and the interior surface of the hollow cylindrical piston 7 is adapted to slidably engage the exterior of the magazine tube 4 upon rearward movement of the piston 7 from its front end position shown in FIG. 1. At its front end the piston means 7 has an inwardly directed flange which slidably engages the exterior surface of the guide means 12 so that in this way the latter serves to guide the piston for rearward movement in the cylinder 2. For this purpose the inwardly directed flange of the piston means 7 has a rear portion 20 extending inwardly from a groove 22 which receives a sealing ring 24. The sealing ring 24 engages a front lip 26 of the piston 7, and between the sealing ring 24 and the flange portion 20 is a ring 28 forming part of the inwardly directed flange of the piston 7 and having at its rear end an outwardly directed flange situated between the flange portion 20 and the sealing ring 24, as illustrated. In this way it is easier to manufacture the piston 7 in such a way that the ring 28 of its inwardly directed front flange will have a proper fit with the exterior of the guide means 12 while the exterior surface of the piston 7 will have a proper fit with the inner surface of the gas cylinder means 2. Thus, the space 10 is defined between the shoulder at the junction between the guide means 12 and the magazine tube 14, the inwardly directed flange of the front end of the piston means 7, considered in the longitudinal direction, and considered radially between the guide means 12 and the cylindrical portion of the piston means 7 which extends rearwardly from its front inwardly directed flange.

The rear end of the piston means 7 butts against a sleeve 30 which surrounds and is slidable along the magazine tube 4, this sleeve 30 being connected in a known way to a mechanism 11 which serves to operate a member which closes an ejection port at the action of the firearm. As is well known, the empty cartridge case of a spent cartridge will be automatically ejected through an ejection port prior to movement of the next round into the firing position, and this ejection port is automatically uncovered by the rearwardly moving sleeve 30 and the transmission 11 connected between the sleeve 30 and the cover member for the port, in a well known manner, the cover member being returned when the bolt is returned, and this return action being utilized to return the parts to the starting position shown in FIG. 1. A predetermined clearance space or gap 14 is defined between the inner surface of the rear cylindrical portion of the piston means 7 and the outer surface of the magazine tube 4 for a purpose referred to below.

The cylindrical wall of the guide means 12 has a forwardly extending portion 32 separated from the guide means 12 by the transverse wall 34 which engages the right end of the spring means 8. This forwardly extending portion 32 extends fluid-tightly through an opening in the front end wall of the gas cylinder means 2, and beyond this front end wall of the gas cylinder means 2 the forwardly extenting portion 32 external threads for receiving a magazine cap 5 which acts as a nut for at least partly fixing the magazine in the illustrated position with respect to the gas cylinder 2 and the barrel 1. The forwardly extending portion 32 forms part of a relief valve means with the hollow interior of the portion 32 communicating with the interior space 9 of the gas cylinder means 2 through a plurality of openings 36 which extend through the wall 32 just forwardly of the transverse partition 34 and which are distributed circumferentially around the axis of the hollow tubular extension 32. The relief valve means includes a valve member 6 which is surged forwardly to its normally closed position by a spring 38. The cap 5 which is threaded onto the front end of the extension 32 has between its ends an inwardly directed flange 40 the inner edge of which is normally engaged by the spring-pressed valve member 6 so as to maintain the space within the extension 32 closed off from the outer atmosphere. Forwardly of this flange the cap 5 has a hollow internally threaded interior receiving a closure plug 42 formed with an axial bore which receives the stem of the valve member 6, and around its central sleeve portion the plug 42 is formed with an annular space which accommodates the spring 38 in the manner illustrated. This plug 42 is simply threaded into the cap 5 and of course it can be utilized for adjusting the force of the spring 38.

Intermediate its ends the cap 5 is formed with radial bores 44 communicating with the space with receives the valve member 6, just forwardly of the flange 40 which defines the opening which is normally closed by the valve member 6.

FIG. 1 also shows a spring-pressed detent structure 46 which cooperates in a known way with the cap 5 providing audible clicks which when they terminate indicate that the cap 5 has been turned to its end position locking the parts in their assembled condition.

With the structure described above and shown in FIG. 1, upon firing of a round gas under pressure will enter through the passage 3 into the internal space 9 of the gas cylinder means 2, driving the piston means 7 rearwardly so that in this way the sleeve 30 and the mechanism 11 are also driven rearwardly for bringing about the automatic operations referred to above. The rearward movement of the piston 7 is limited by engagement between the inwardly directed front flange thereof and the shoulder at the junction between the magazine tube 4 and its extension 12. Between the inner ring 28 of the front flange of the piston 7 and the exterior surface of the guide means 12 a predetermined gap or clearance is provided so that part of the gas under pressure will flow into the space 10 for cushioning the rearward movement of the piston means 7, and this gas in the space 10 can escape to the outer atmosphere through the clearance 14 provided between the rear cylindrical portion of the piston 7 and the exterior surface of the magazine tube 4, as described above. In this way it is possible to brake the rearward movement of the gas piston means 7 so that the sleeve 30 and mechanism 11 will not be driven too rapidly. It is thus apparent that the inner portion of the inner ring 28 which has the inner surface surrounding the guide means 12 and the exterior surface portion of the later which is surrounded by the ring 28 cooperate to form a gas-passage means communicating with the spaces on both sides of the inwardly directed front flange of the piston 7 for directing some of the gas from the front toward the rear side of the flange of piston 7 in order to act as a brake for cushioning the rearward movement of the piston means 7, as pointed out above.

In the event that there is an excessive pressure in the gas received in the space 9, due to firing of a round with a greater than average charge, for example, this gas under pressure which communicates through the openings 36 with the interior of the extension 32 will act on the valve member 6 to displace the latter in opposition to the spring 38 for enabling part of the gas under pressure to escape to the outer atmosphere through the apertures 44 in the magazine cap 5, as illustrated by the arrows in FIG. 1, so that in this way the relief valve means serves to prevent excessive pressure in the space 9.

Figure 2:
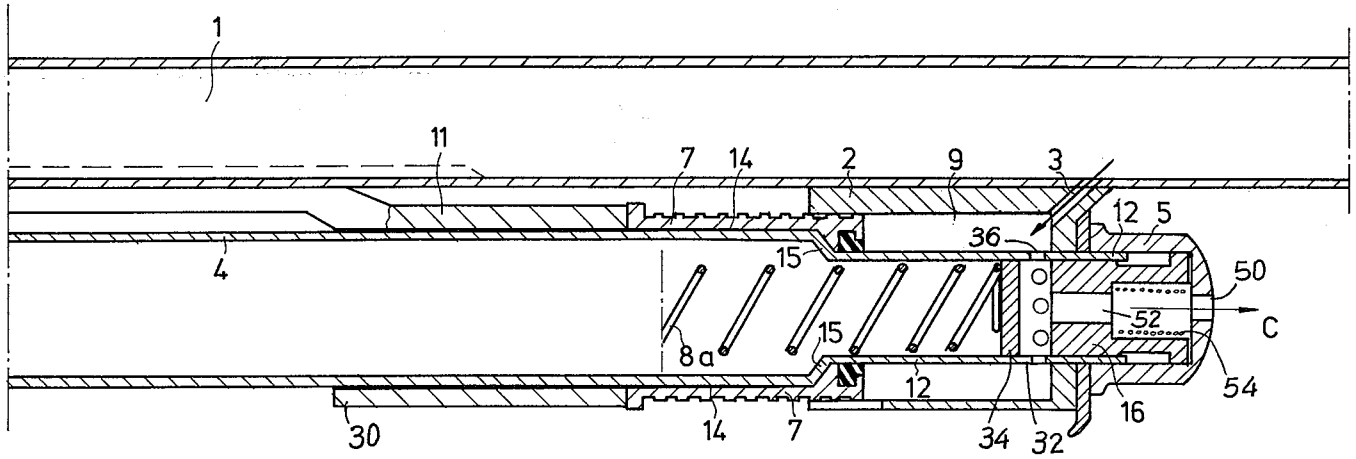
FIG. 2 is a fragmentary sectional elevation of another embodiment of a construction in accordance with the present invention, the section of FIG. 2 also being taken in a plane which contains the axis of the barrel as well as the common axis of the magazine tube and gas cylinder, with the embodiment of FIG. 2 differing from that of FIG. 1 in that the guide means forms an integral extension of the magazine tube and in that the relief valve means of FIG. 2 has a construction different from the relief valve means of FIG. 1.

The embodiment of FIG. 2 includes components similar to those of FIG. 1 and designated by the same reference characters. The embodiment of FIG. 2 differs in one respect from FIG. 1 in that the elongated hollow guide means 12 forms an integral extension of the magazine tube 4. For this purpose the magazine tube 4 and extension 12 thereof are interconnected by a tapered portion 15 forming part of a cone so that this portion 15 also forms a forwardly directed shoulder for coacting with the inwardly directed flange of the piston means 7 in the manner illustrated in FIG. 2. Thus the piston means 7 is shown in FIG. 2 at the end of its stroke where the inwardly directed flange engages the shoulder formed by the tapered portion 15 so that the space 10 has eliminated. The spring means 8a of FIG. 2 corresponds to the spring means 8 of FIG. 1 and acts in the same way. Forwardly of the transverse partition 34, the internal space of the extension 32 also communicates with the space 9 through the apertures 36. However in this case the relief valve means takes the form of an inertia type of valve responding to recoil of the firearm. The front end of the extension 32 of the guide means 12, where it extends beyond the front end wall of the gas cylinder means 2, is externally threaded to receive the internally threaded magazine cap 5 which is illustrated in FIG. 2 for locking the parts in their assembled condition as illustrated. However in this case the magazine cap 5 has a front end wall formed only with a simple opening 50 coaxial with the common axis of the cylinder 2 and the piston 7.

The relief valve means of FIG. 2 includes an axially slidable valve member 16 of a sufficiently great mass to have the required inertia to provide automatic opening of the relief valve upon recoil of the gun when a round is fired. This inertia valve 16 is formed with an axial bore 52 and is urged rearwardly to its closed position by a spring 54. The valve 16 is shown in its open position. When it is in its close position, the left end surface of the valve member 16 engages the partition 34 so that the apertures 36 are closed by the exterior surface of the valve member 16. Upon firing of a round, the firearm will recoil so that the barrel 1 together with the gas cylinder 2 will move rearwardly. However, the inertia valve member 16 will remain stationary due to its inertia so that the extension 32 will slide rearwardly upon recoil with respect to the stationary inertia valve member 16, thus displacing the apertures 36 to the left of the valve member 16 in opposition to the spring 54 and enabling gas under pressure in the space 9 to enter through the apertures 36 into the space between the valve member 16 and the partition 34. Once the gas under pressure has entered into this space the gas under pressure itself will act to move the valve member 16 forwardly with respect to the tubular extension 32 of the guide means 12. The gas which enters in this way through the apertures 36 into the space between partition 34 and valve member 16 can flow to the outer atmosphere through the bore 52 and the aperture 50, so that in this way the structure of FIG. 2 operates to relieve excess pressure encountered in the space 9.

It is to be noted in connection with FIG. 2 that the clearance between the inwardly directed front flange of the gas piston 7 and the guide means 12 as well as the clearance space 14 are given a predetermined magnitude which will provide the cushioning of the piston means 7 and the braking of the rearward movement thereof in the manner described above in connection with FIG. 1.

It is thus apparent that with the above-described structure of the invention there is a considerable saving of space in that the gas piston 7 is guided by the hollow guide means 12 which forms an extension of the magazine and which in fact forms part of the magazine since a considerable part of the spring 8 or 8a is accommodated in the hollow interior of the guide means 12. In this way even though the structure of the invention is not undesirably long, considered longitudinally of the barrel, neverless the entire interior space of the magazine is available for accommodating the charge exclusively, so that the gas-operated structure is not provided with the present invention at a sacrifice of interior magazine space. The rearwardly driven sleeve 30 acts through the lock-return rails 11 on the closure or lock member for the ejection port as referred to above, and just in advance of the sleeve 30 through the gap 14 part of the excess pressure is discharged to the outer atmosphere from the space 10, with the resulting desired braking of the movement of the gas piston, while excess gas under pressure is discharged by way of either of the above-described relief valves. It will be noted that these relief valves are easily accommodated as forward extensions of the guide 12, while at the same time the transverse dimensions of the structure are not undesirably excessive.

What is claimed is:

1. In a firearm, a barrel, gas cylinder means having an axis parallel to said barrel, said gas cylinder means being fixed to a lower portion of said barrel and communicating with the interior thereof for receiving gas under pressure upon firing of a round, elongated magazine means coaxial with said gas cylinder means and extending rearwardly therefrom beneath said barrel, guide means fixed to and forming a forward extension of said magazine means, said guide means extending coaxially into said gas cylinder means, gas piston means situated in said gas cylinder means for movement rearwardly therein when gas under pressure is received in said gas cylinder means, said gas piston means surrounding and being guided by said guide means and also being surrounded and guided by said gas cylinder means, automatically operable means operatively connected with said gas piston means to be operated automatically thereby when said gas piston means moves rearwardly in said cylinder means, gas-passage means communcating with spaces in said cylinder means situated before and behind said gas piston means for admitting some gas from the space before said gas piston means to the space behind the latter for braking the rearward movement of said gas piston means, and relief valve means fixed to and forming a forward extension of said guide means, said relief valve means communicating on the one hand with the interior of said gas cylinder means forwardly of said gas piston means and on the other hand with the outer atmosphere for relieving excess pressure encountered in said gas cylinder means when gas under pressure is received therein.

2. The combination of claim 1 and wherein said guide means has a smaller diameter than said magazine means.

3. The combination of claim 2 and wherein said guide means terminates at its rear end in an outwardly directed shoulder surrounding the rear end of said guide means where it is connected with the front end of said magazine means, said gas piston means having a rear cylindrical portion which slides on said magazine means rearwardly of said shoulder during rearward movement of said piston means in said gas cylinder means, and said piston means having at its front end an inwardly directed flange slidably engaging said guide means and limited in its rearward movement by said shoulder.

4. The combination of claim 3 and wherein said guide means forms an integral extension of said magazine means and said shoulder is tapered.

5. The combination of claim 4 and wherein said inwardly directed flange of said piston means has a rear tapered surface matching the taper of said shoulder.

6. The combination of claim 3 and wherein said guide means is hollow and has an interior space forming a continuation of an interior space of said magazine means, and spring means situated in said magazine means for urging rounds therein rearwardly, said spring means extending from the interior of said magazine means into the interior of said guide means.

7. The combination of claim 3 and wherein said gas-passage means includes an inner portion of said inwardly directed flange which surrounds said guide means and an outer surface portion of the latter which is surrounded by said inner portion of said flange with a predetermined clearance permitting some gas under pressure to enter into the space between said flange of said piston means and said shoulder for braking the rearward movement of said piston means.

8. The combination of claim 7 and wherein the cylindrical portion of said piston means which slides rearwardly along said magazine means has with respect to the latter a predetermined clearance through which gas under pressure can escape in a regulated manner also contributing to the braking of the rearward movement of said piston means.

9. The combination of claim 1 and wherein said relief valve means extends forwardly from said guide means fluid-tightly through a front end wall of said cylinder means and communicates forwardly of said front end wall of said cylinder means with the outer atmosphere.

* * * * *